US007916107B2

(12) United States Patent
Chen et al.

(10) Patent No.: US 7,916,107 B2
(45) Date of Patent: Mar. 29, 2011

(54) GAMMA VOLTAGE OUTPUT CIRCUIT AND LIQUID CRYSTAL DISPLAY HAVING SAME

(75) Inventors: Sz-Hsiao Chen, Miao-Li (TW); Man-Fai Ieong, Miao-Li (TW)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 917 days.

(21) Appl. No.: 11/880,572

(22) Filed: Jul. 23, 2007

(65) Prior Publication Data

US 2008/0049008 A1 Feb. 28, 2008

(30) Foreign Application Priority Data

Jul. 21, 2006 (TW) ..... 95126674 A

(51) Int. Cl.
*G09G 3/36* (2006.01)

(52) U.S. Cl. ..... 345/89

(58) Field of Classification Search ..... 345/89, 345/211, 95, 690
See application file for complete search history.

(56) References Cited

U.S. PATENT DOCUMENTS

| | | | | |
|---|---|---|---|---|
| 5,854,627 | A * | 12/1998 | Kurihara et al. | 345/211 |
| 6,075,477 | A * | 6/2000 | Kokubun et al. | 341/154 |
| 6,680,755 | B2 | 1/2004 | Shen et al. | |
| 6,836,232 | B2 | 12/2004 | Bu | |
| 7,106,321 | B2 * | 9/2006 | Morita | 345/211 |
| 2003/0053321 | A1 * | 3/2003 | Ishiyama | 363/59 |
| 2006/0022925 | A1 | 2/2006 | Hara et al. | |
| 2006/0192695 | A1 * | 8/2006 | Nishimura | 341/51 |

FOREIGN PATENT DOCUMENTS

CN 1728227 A 2/2006

* cited by examiner

*Primary Examiner* — Chanh Nguyen
*Assistant Examiner* — Jonathan Blancha
(74) *Attorney, Agent, or Firm* — Wei Te Chung

(57) ABSTRACT

An exemplary gamma voltage output circuit (3) has an internal resistor string (31), which has a plurality of resistors and a plurality of nodes; at least one external resistor string (32, 33, 34), which has a plurality of resistors and a plurality of nodes; a plurality of switching circuit (35), each switching circuit having at least one input end (353, 354, 355) and at least one output end (356). The internal and the at least one external resistor strings connect in series between the power source AVDD and ground, respectively. Each node outputs a gamma voltage. The nodes of internal and the at least one external resistor strings respectively are connected to the output end and the input end, the resistors of the internal resistor string parallel connecting to corresponding resistors of the at least one external resistor string through the corresponding switching circuit.

20 Claims, 7 Drawing Sheets

GAMMA VOLTAGE OUTPUT CIRCUIT AND LIQUID CRYSTAL DISPLAY HAVING SAME

FIELD OF THE INVENTION

The present invention relates to voltage output circuits, and more particularly to a gamma voltage output circuit for driving a liquid crystal display (LCD) and a liquid crystal display having the same.

BACKGROUND

LCDs are commonly used as display devices for compact electronic apparatuses, because they not only provide good quality images with little power but also are very thin. In general, an LCD includes a liquid crystal panel and a backlight module for illuminating the liquid crystal panel.

In an active matrix liquid crystal display (AM-LCD) system, the character curve in FIG. 5 which shows the transmittance of the liquid crystal versus the applied gamma driving voltage in an actual AM-LCD, is a non-linear curve, not linear curve. In operation, the liquid crystal display changes the optical transmittance of the liquid crystal molecular through changing the applied driving voltage between the upper and the lower substrates, for displaying image. The applied driving voltage is named gamma voltage.

FIG. 6 is a character curve, which shows the transmittance of the liquid crystal versus the gray level. The character curve is named gamma curve. The relationship between the transmittance of liquid crystal and the gray level maintains the following function:

$$T=T\max*(G/G\max)^{r}$$

wherein T represents transmittance of liquid crystal; Tmax Represents the maximal transmittance of liquid crystal; G represents gray level; Gmax represents the maximal gray level corresponding to the maximal transmittance of liquid crystal; r represents gamma value. In FIG. 6, the gamma value of the gamma curve equals to 1.0. When the relationship between the transmittance of liquid crystal and the gray level maintains the gamma curve of FIG. 6, the liquid crystal display has an ideal vision effect for human eyes. However, actually, the transmittance of liquid crystal and the gray level has a non-linear relationship. Thus, a special circuit for a liquid crystal display is needed to output corresponding gamma voltage to make the relationship between the transmittance of liquid crystal and the gray level maintains the gamma curve of FIG. 6, i.e. linear relationship.

Referring to FIG. 7, a typical gamma voltage output circuit is shown. The gamma voltage output circuit 1 is capable of outputting gamma voltage signals to display gray scale images with sixty-four levels. That is, the gamma voltage output circuit 1 can output sixty-four gamma voltages V1~V64.

The gamma voltage output circuit 1 includes: a resistor string 11 connected between an analog electrical source (AVDD) and ground. The resistor string 11 includes sixty-five resistors R0~R64 connected in series.

However, movable or portable display are usually operated under different external environment, such as cloudy day, sun day, or night, et. Under different external environment, the display images produce different color bias if only single gamma curve is used in the movable or portal display. That is the transmittance corresponding to the gray level cannot be properly displayed under different external environments. Thus, different gamma curves are needed for different external environments. Referring to FIG. 8, three different gamma curves are shown corresponding to three different external environments, which respectively represent gamma values of 1.0, 2.0 and 3.0.

FIG. 9 shows another typical gamma voltage output circuit which can provide three gamma voltages. The gamma voltage output circuit 2 includes a first resistance string 21, a second resistance string 22 and a third resistance string 23, respectively connecting in series between a power supply AVDD and ground. The first resistor string 21 has sixty-five resistors R0_1~R64_1 and sixty-four nodes, the sixty-four nodes corresponding to sixty-four gamma voltages V1_1~V64_1. The second resistor string 22 has sixty-five resistors R0_2~R64_2 and sixty-four nodes, the sixty-four nodes corresponding to sixty-four gamma voltages V1_2~V64_2. The third resistor string 23 has sixty-five resistors R0_3~R64_3 and sixty-four nodes, the sixty-four nodes corresponding to sixty-four gamma voltages V1_3~V64_3. By adjusting the resistance value of each resistor, three gamma curves shown on FIG. 8 can be attained.

When three gamma curves is needed, the gamma voltage output circuit 2 has thrice the number of the resistors of the gamma voltage output circuit 2. However, when eight or ten or more gamma curves are needed, the number of the resisors of the gamma voltage output circuit can be enormous. For designing or manufacturing an integrated circuit (IC), more resisotrs, more cost.

In the gamma voltage output circuit 1, the voltage output from the analog electrical source is distributed to the resistors R0~R14 of the resistor string 11, and the capacitors have a function of wave filtering. Each operational amplifier 12 improves the capability of equipping loads. The gamma voltage output from the output port of each operational amplifier 12 is equal to the voltage signal inputted into the non-inverting input port of the same operational amplifier 12. Thus, each gamma voltage can be calculated according to the following equations:

$$V1=AVDD*(R1+R2+\ldots+R14)/(R0+R1+R2+\ldots+R14)$$

$$V2=AVDD*(R2+\ldots+R14)/(R0+R1+R2+\ldots+R14)$$

$$\ldots$$

$$V14=AVDD*R14/(R0+R1R2+\ldots+R14)$$

In order to increase the precision of the resistors R0~R14, the configuration of the resistor string 11 can usually be varied. Referring to FIG. 4, the resistors R01 and R02 are connected in parallel, and a resistance of the parallel connected resistors R01 and R02 is equal to that of the resistor R0. The resistors R11 and R12 are connected in parallel, and a resistance of the parallel connected resistors R11 and R12 is equal to that of the resistor R1. In other words, each pair of resistors Rm1 and Rm2 are connected in parallel, and a resistance of the parallel connected resistors Rm1 and Rm2 is equal to that of the resistor Rm ($0 \leqq m \leqq 14$). Thus the resistance of the resistors R0~R14 can be suitably configured by controlling the resistances of the resistors Rm1~Rm2.

When the gamma voltages need to be modulated, the resistances of the corresponding resistors need to be adjusted. For example, when the gamma voltage V2 needs to be modulated, then the resistance of the resistors R2 (R21 and R22) needs to be adjusted. However, according to the equations shown above, when the resistance of one of the resistors is varied, the value of other output gamma voltages also varies. That is, the gamma voltages output from the gamma voltage output circuit 1 affect one another, and cannot be adjusted individually.

Accordingly, what is needed is a gamma voltage output circuit that can overcome the above-described deficiencies.

SUMMARY

An exemplary gamma voltage output circuit for a liquid crystal display has an internal resistor string, which has a plurality of resistors and a plurality of nodes; at least one external resistor string, which has a plurality of resistors and a plurality of nodes; a plurality of switching circuit, each switching circuit having at least one input end and at least one output end. The internal and the at least one external resistor strings connect in series between the power source AVDD and ground, respectively. Each node outputs a gamma voltage. The nodes of internal and the at least one external resistor strings respectively are connected to the at least one output end and the at least one input end, the resistors of the internal resistor string parallel connecting to corresponding resistors of the at least one external resistor string through the corresponding switching circuit.

A exemplary liquid crystal display has a printed circuit board, which has a driving IC (not shown) and a gamma voltage output circuit. The gamma voltage output circuit for a liquid crystal display has an internal resistor string, which has a plurality of resistors and a plurality of nodes; at least one external resistor string, which has a plurality of resistors and a plurality of nodes; a plurality of switching circuit, each switching circuit having at least one input end and at least one output end. The internal and the at least one external resistor strings connect in series between the power source AVDD and ground, respectively. Each node outputs a gamma voltage. The nodes of internal and the at least one external resistor strings respectively are connected to the at least one output end and the at least one input end, the resistors of the internal resistor string parallel connecting to corresponding resistors of the at least one external resistor string through the corresponding switching circuit.

Other novel features and advantages will become apparent from the following detailed description of preferred and exemplary embodiments when taken in conjunction with the accompanying drawings.

DETAILED DESCRIPTION OF PREFERRED EMBODIMENTS

Reference will now be made to the drawings to describe preferred and exemplary embodiments in detail.

Figure 1:
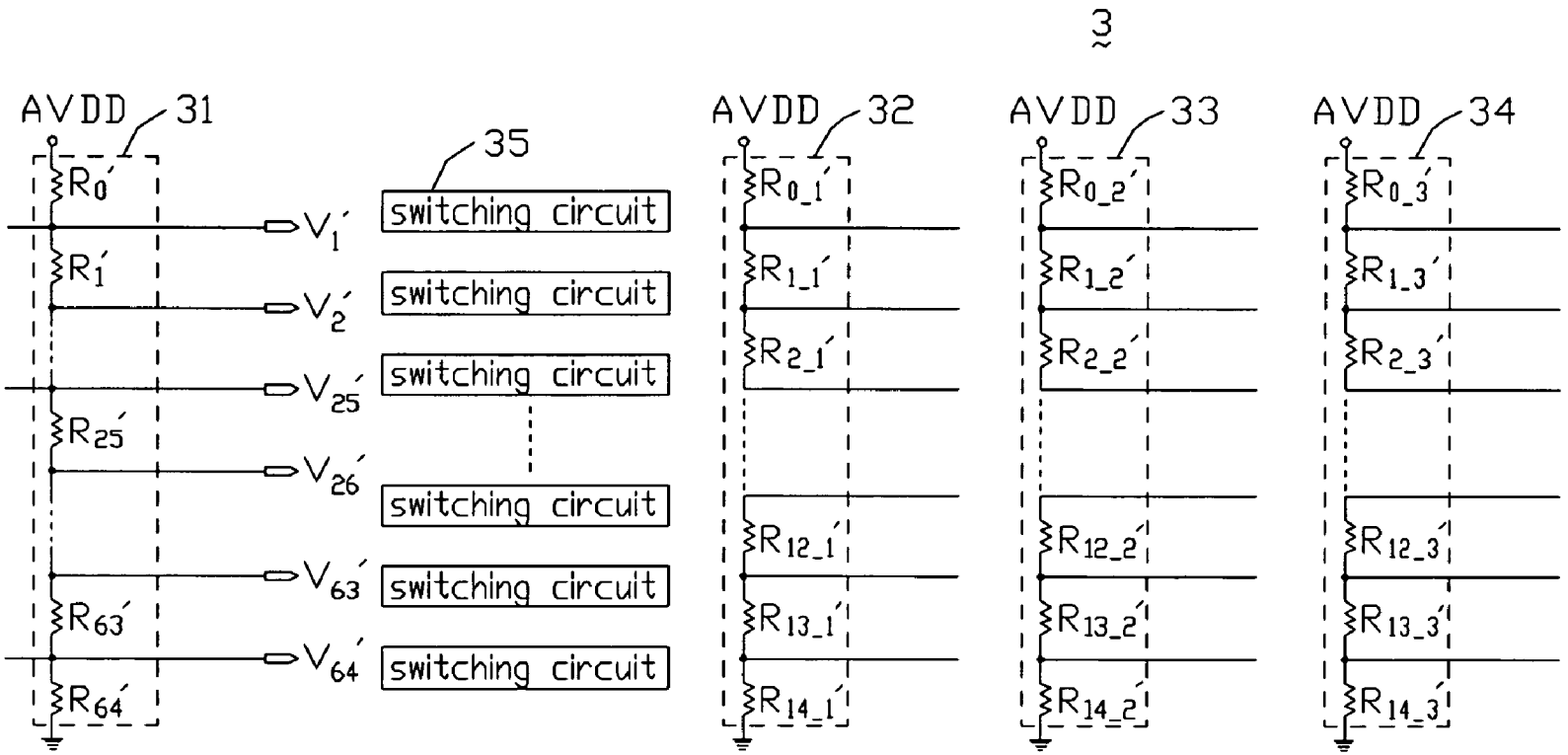
FIG. 1 is an abbreviated diagram of a gamma voltage output circuit according to an exemplary embodiment of the present invention, which includes a switching circuit, a first resistors string, a second resistors string.

Referring to FIG. 1, a gamma voltage output circuit of a liquid crystal display according to an embodiment of the present invention is shown. The liquid crystal display includes a printed circuit board (not shown), which has a driving IC (not shown) and a gamma voltage output circuit 3. The gamma voltage output circuit 3 includes a first resistor string 31, a second resistor string 32, a third resistor string 33 and a fourth resistor string 34, respectively connecting in series between the power source AVDD and ground, and a plurality of switching circuits 35. The first resistor string 31 is disposed in the driving IC, named as internal resistor strings, which includes sixty-five resistors R'0~R'64 and sixty-four nodes, the sixty-four nodes corresponding to sixty-four gamma voltages V'1~V'64. The second, third and fourth resistor strings 32, 33, 34 and the plurality of switching circuits 35 are formed out of the driving IC, named as external resistor string. The second resistor string 32 includes fifteen resistors R'0_1~R'14_1 and fourteen nodes; the third resistor string 33 includes fifteen resistors R'0_2~R'14_2 and fourteen nodes; and the fourth resistor string 34 includes fifteen resistors R'0_3~R'14_3 and fourteen nodes. The number of the plurality of switching circuit 35 is fourteen.

Figure 2:
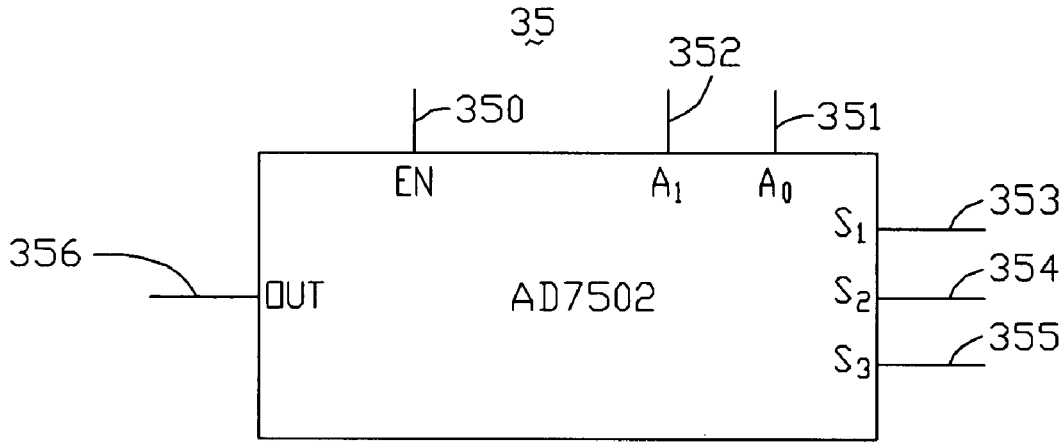
FIG. 2 is a abbreviated diagram of the switching circuit of the gamma voltage output circuit of FIG. 1.

The circuit configuration of each switching circuit 35 is shown in FIG. 2, which has an enabling signal input end (EN) 350, a first controlling signal input end (A0) 351, a second controlling signal input end (A1) 352, a first input end (S1) 353, a second input end (S2) 354, a third input end (S3) 353, and an output end (OUT) 356. The switching circuit 35 in the embodiment employs analog switch AD7502. The first input ends (S1) 353 of the fourteen switching circuits 35 respectively electrically connect with the fourteen nodes of the second resistor string 32. The second input ends (S2) 354 of the fourteen switching circuits 35 respectively electrically connect with the fourteen nodes of the third resistor string 33. The third input ends (S3) 355 of the fourteen switching circuits 35 respectively electrically connect with the fourteen nodes of the fourth resistor string 34. The output ends (OUT) 356 of the fourteen switching circuits 35 respectively electrically connect with fourteen nodes of the sixty-four nodes of the first resistor string 31. For different gamma voltage output circuits, the fourteen nodes can be chosen according to different needs. But, for a certain gamma voltage output circuit, the fourteen nodes are changeless.

Figure 3:
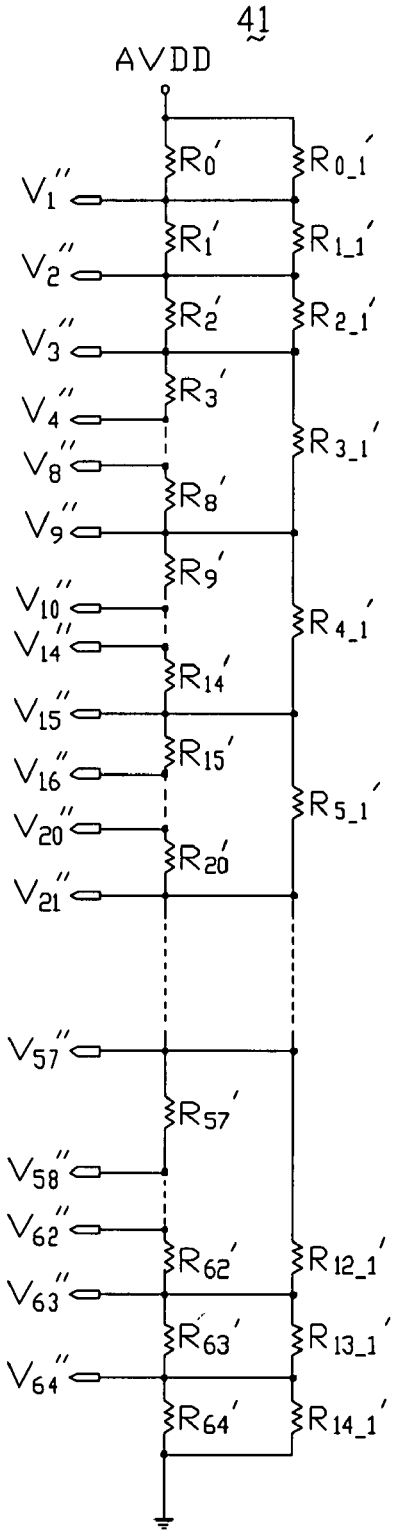
FIG. 3 is an abbreviated diagram showing the parallel connection between the first resistors string and the second resistors string of the gamma voltage output circuit of FIG. 1.

In operation, when the driving IC sends a high level signal to the enabling signal input end (EN) 350 of the switching circuit 35, the switching circuit 35 starts to work. When the first and the second controlling signal input ends (A0, A1) 351, 352 respectively receive a low level signal, the first input end (S1) 353 electrically connects with the output end (OUT) 356. That is, the resistors of the first resistor string 31 parallel connect to the corresponding resistor of the second resistors string 32. The corresponding resistor of the second resistors string 32 can be chosen according to different needs. FIG. 3 provides one parallel connecting circuitry 41. In FIG. 3, the resistor R'0 parallel connects to the resistor R'0_1; the resistor R'1 parallel connects to the resistor R'1_1; the resistor R'2 parallel connects to the resistor R'2_1; the resistor R'63 parallel connects to the resistor R'13_1; the resistor R'34 parallel connects to the resistor R'14_1. In addition, each six continuous resistors of resistor R'3~R'62 parallel connect to one resistor of R'3_1~R'12_1, such as resistors R'(3+6n)~R'(8+6n) (0≦n≦9) parallel connect to R'(3+n)_1. The sixty-four nodes of the first resistor string 31 respectively output gamma voltages V"1~V"64.

Figure 4:
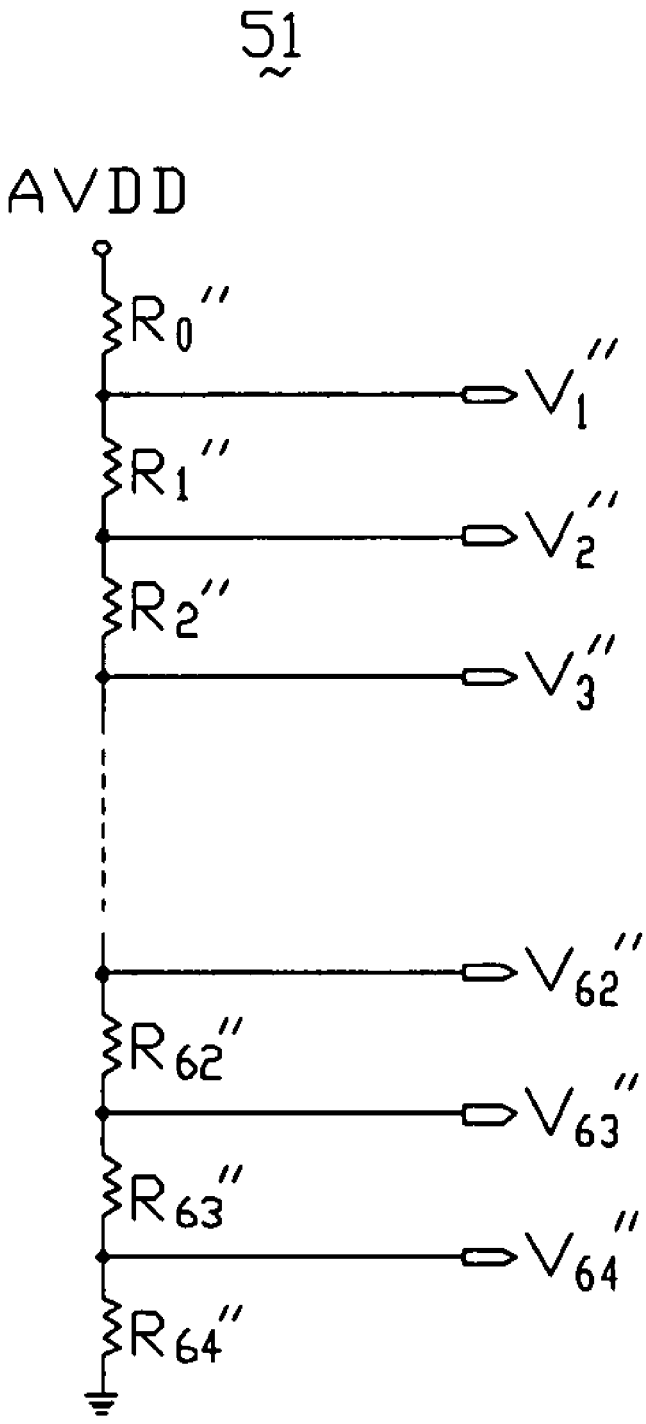
FIG. 4 is an abbreviated equivalent circuitry of the parallel connection between the first resistors string and the second resistors string of the gamma voltage output circuit of FIG. 3.
Figure 5:
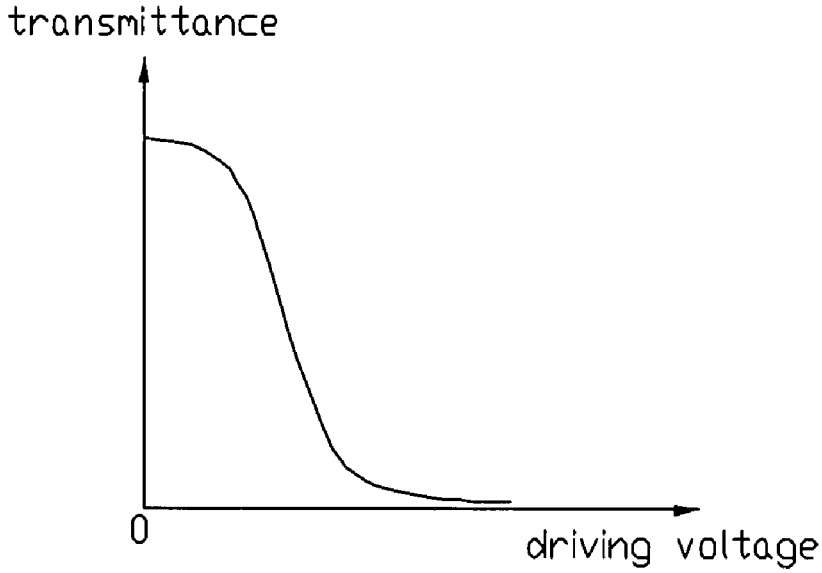
FIG. 5 (RELATED ART)
FIG. 5 is a diagram showing the transmittance of the liquid crystal versus the applied driving voltage.
Figure 6:
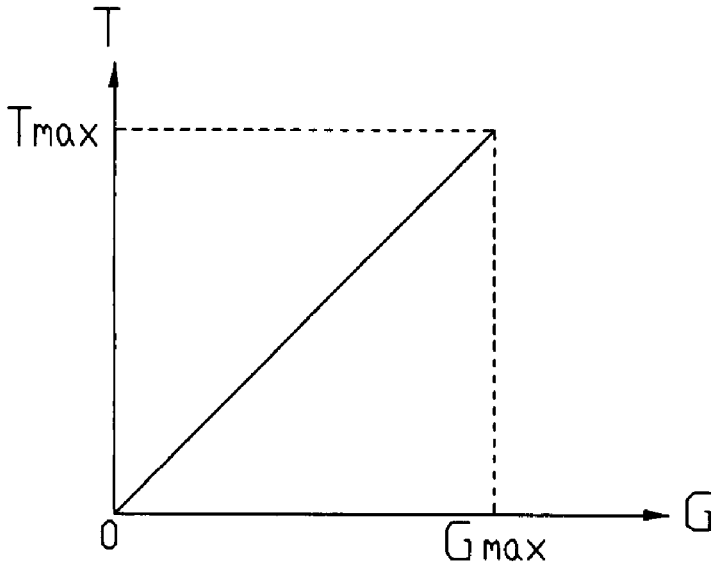
FIG. 6 (RELATED ART)
FIG. 6 is a diagram showing the transmittance of the liquid crystal versus the gray level.
Figure 7:
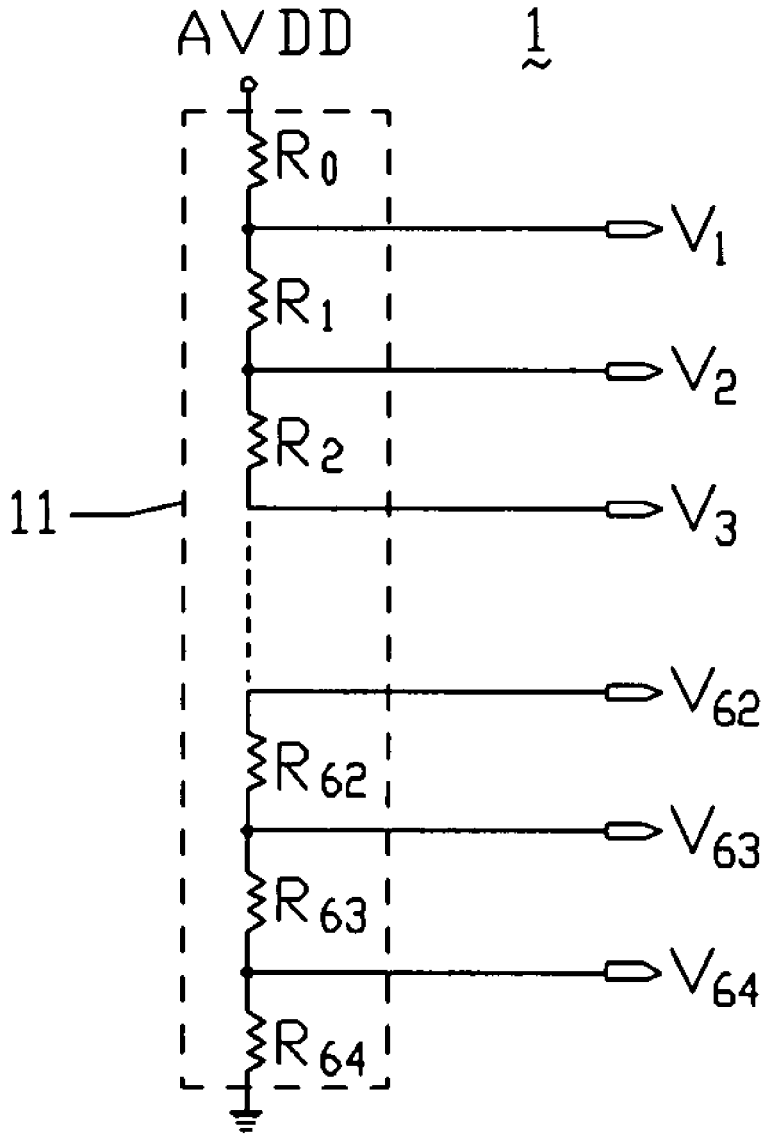
FIG. 7 (RELATED ART)
FIG. 7 is a schematic diagram, showing a conventional gamma voltage output circuit.
Figure 8:
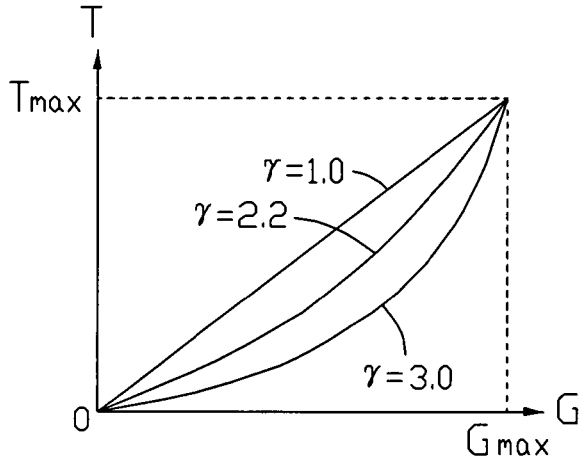
FIG. 8 (RELATED ART)
FIG. 8 is a diagram, showing three gamma curves of transmittance of the liquid crystals versus the gray level, having gamma values of 1.0, 2.0, 3.0.
Figure 9:
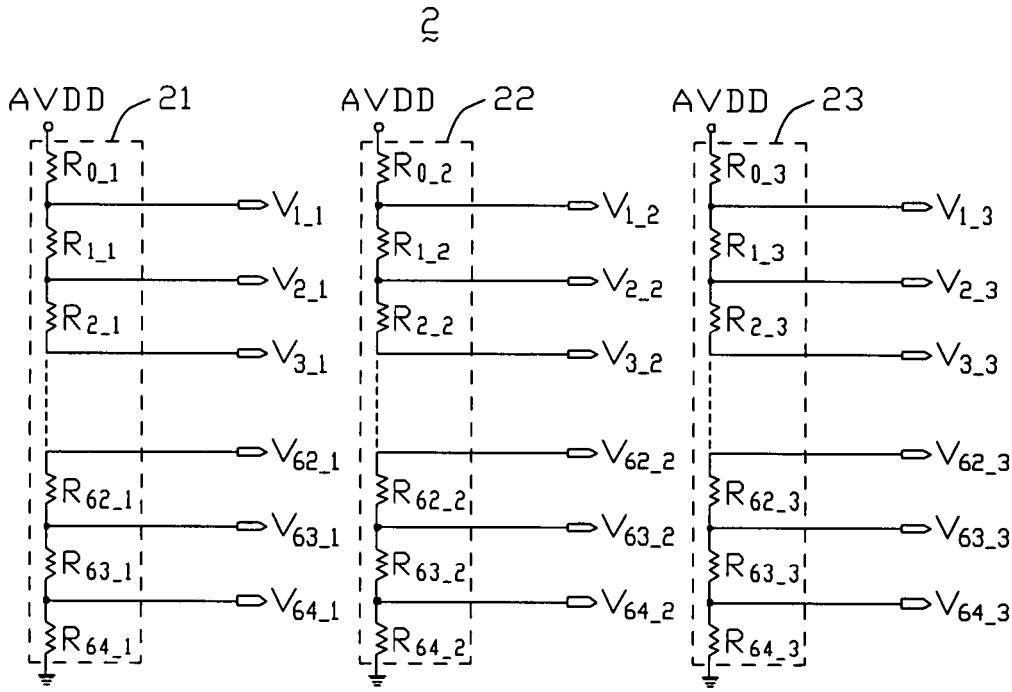
FIG. 9 (RELATED ART)
FIG. 9 is a schematic diagram, showing an another conventional gamma voltage output circuit.

FIG. 4 shows the equivalent scheme 51 of the parallel circuitry 41 of FIG. 3, the equivalent scheme 51 has sixty-five equivalent resistance R"0~R"64 and sixty-four nodes. Each node output one gamma voltage. A serial voltages V"1~V"64 of the equivalent scheme 51 correspond to one gamma curve.

When the driving IC sends a high level signal to the enabling signal input end (EN) 350 of the switching circuit 35, and the first and the second controlling signal input ends (A0, A1) 351, 352 of the switching circuit 35 respectively receive a high level signal and a low level signal, the second input end (S2) 354 electrically connects with the output end (OUT) 356. That is, the resistors of the first resistor string 31 parallel connect to the corresponding resistor of the third resistors string 33, similar to the second resistors string 32. when the driving IC sends a high level signal to the enabling signal input end (EN) 350 of the switching circuit 35, and the first and the second controlling signal input ends (A0, A1) 351, 352 of the switching circuit 35 respectively receive a low level signal and a high level signal, the second input end (S3) 355 electrically connects with the output end (OUT) 356. That is, the resistors of the first resistor string 31 parallel connect to the corresponding resistor of the fourth resistors string 34, similar to the second resistors string 32. When the driving IC sends a low level signal to the enabling signal input end (EN) 350 of the switching circuit 35, the switching circuit 35 turns off.

In the gamma voltage output circuit 3, the numbers of the second, third, fourth resistors strings 32, 33, 34 can also be others. And, the number of the plurality of switching circuits 35 can be determined according to the numbers of the second, third, fourth resistors strings 32, 33, 34.

Comparing to prior arts, the gamma voltage output circuit 3 does not need change the internal circuit configuration of the driving IC, which just add a quantity of resistors at an external peripheral region of the driving IC to realize gamma voltages adjusting according to different needs. Thus, a good displaying characteristics can be attained even in different external environments.

When the LCD needs to be operated in more different external environments, the number of the external resistors string needs to be added. However, the internal circuitry configuration does not need to be changed.

When the driving IC of the LCD is eight bit or ten bit, the number of the internal resistors string is two hundred fifty-six or one thousand twenty-four. However, the number of each external resistors string does not need to be changed or just change a small quantities, such as add to twenty or thirty.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A gamma voltage output circuit for a liquid crystal display, the gamma voltage output circuit comprising:

an internal resistor string, comprising a plurality of resistors and a plurality of nodes;

at least one external resistor string, comprising a plurality of resistors and a plurality of nodes;

a plurality of switching circuits, each switching circuit comprising at least one input end and at least one output end;

wherein the internal and the at least one external resistor strings connect in series between a power source AVDD and ground, respectively, each node outputting a gamma voltage, the nodes of internal and the at least one external resistor strings respectively being connected to the at least one output end and the at least one input end, the resistors of the internal resistor string parallel connecting to corresponding resistors of the at least one external resistor string through the corresponding switching circuit, wherein the at least one external resistor string comprises three external resistor strings, which are a first external resistor string, a second external resistor string and a third external resistor string, and each switching circuit comprises three input ends, which are a first input end, a second input end, and a third input end, in which the plurality of nodes of the first external resistor string respectively connects with the first input ends of the plurality of switching circuits, and the plurality of nodes of the second external resistor string respectively connects with the second input ends of the plurality of switching circuits, and the plurality of nodes of the third external resistor string respectively connects with the third input ends of the plurality of switching circuits, wherein each switching circuit comprises an enabling signal input end, a first controlling signal input end, and a second controlling signal input end, when the enabling signal input end receives a high level signal, and the first and the second controlling signal input ends of the switching circuit respectively receive a low level signal, the first input end electrically connects with the output end.

2. The gamma voltage output circuit as claimed in claim 1, wherein when the enabling signal input end receives a high level signal, and the first and the second controlling signal input ends of the switching circuit respectively receive a high level signal and a low level signal, the second input end electrically connects with the output end.

3. The gamma voltage output circuit as claimed in claim 2, wherein when the enabling signal input end receives a high level signal, and the first and the second controlling signal input ends of the switching circuit respectively receive a low level signal and a high level signal, the third input end electrically connects with the output end.

4. The gamma voltage output circuit as claimed in claim 3, wherein when the enabling signal input end receives a low level signal, the switching circuit stops to work.

5. The gamma voltage output circuit as claimed in claim 4, wherein the switching circuit employs analog switch AD7502.

6. The gamma voltage output circuit as claimed in claim 1, wherein the first, the second, and the third external resistor string have same number of resistors.

7. The gamma voltage output circuit as claimed in claim 6, wherein the number of the resistors of the first, the second, and the third external resistor string is fifteen, respectively.

8. The gamma voltage output circuit as claimed in claim 6, wherein the number of the resistors of the internal resistor string is larger than that of the first external resistor string.

9. The gamma voltage output circuit as claimed in claim 6, wherein the number of the resistors of the internal resistor string is sixty-five.

10. A gamma voltage output circuit for a liquid crystal display, the gamma voltage output circuit comprising:

an internal resistor string, comprising a plurality of resistors and a plurality of nodes;

at least one external resistor string, comprising a plurality of resistors and a plurality of nodes;

a plurality of switching circuits, each switching circuit comprising at least one input end and at least one output end;

wherein the internal and the at least one external resistor strings connect in series between a power source AVDD and ground, respectively, each node outputting a gamma voltage, the nodes of internal and the at least one external resistor strings respectively being connected to the at least one output end and the at least one input end, the resistors of the internal resistor string parallel connecting to corresponding resistors of the at least one external resistor string through the corresponding switching circuit, wherein the at least one external resistor string comprises three external resistor strings, which are a first external resistor string, a second external resistor string and a third external resistor string, and each switching circuit comprises three input ends, which are a first input end, a second input end, and a third input end, in which the plurality of nodes of the first external resistor string respectively connects with the first input ends of the plurality of switching circuits, and the plurality of nodes of the second external resistor string respectively connects with the second input ends of the plurality of switching circuits, and the plurality of nodes of the third external resistor string respectively connects with the third input ends of the plurality of switching circuits, wherein each switching circuit comprises an enabling signal input end, a first controlling signal input end, and a second controlling signal input end, when the enabling signal input end receives a high level signal, and the first and the second controlling signal input ends of the switching circuit respectively receive a low level signal, the first input end electrically connects with the output end.

11. The liquid crystal display as claimed in claim 10, wherein when the enabling signal input end receives a high level signal, and the first and the second controlling signal input ends of the switching circuit respectively receive a high level signal and a low level signal, the second input end electrically connects with the output end.

12. The liquid crystal display as claimed in claim 11, wherein when the enabling signal input end receives a high level signal, and the first and the second controlling signal input ends of the switching circuit respectively receive a low level signal and a high level signal, the third input end electrically connects with the output end.

13. The liquid crystal display as claimed in claim 12, wherein when the enabling signal input end receives a low level signal, the switching circuit stops to work.

14. The liquid crystal display as claimed in claim 13, wherein the switching circuit employs analog switch AD7502.

15. The liquid crystal display as claimed in claim 10, wherein the first, the second, and the third external resistor string have same number of resistors.

16. The liquid crystal display as claimed in claim 15, wherein the number of the resistors of the internal resistor string is larger than that of the first external resistor string.

17. The gamma voltage output circuit as claimed in claim 16, wherein when the enabling signal input end receives a low level signal, the switching circuit stops to work.

18. A gamma voltage output circuit for a liquid crystal display, the gamma voltage output circuit comprising:

an internal resistor string connecting between a power source and ground, the internal resistor string comprising a plurality of resistors connecting in series and a plurality of nodes, each node of the internal resistor string for outputting a gamma voltage;

a first external resistor string connecting between the power source and the ground, the first external resistor string comprising a plurality of resistors connecting in series and a plurality of nodes; and a plurality of switching circuits, each switching circuit comprising a first input end, an output end, an enabling signal input end, a first controlling signal input end, and a second controlling signal input end, the first input end of each switching circuit connected to each node of the first external resistor string, the output end of each switching circuit connected to each node of the internal resistor string;

wherein when the enabling signal input end receives a high level signal, and the first and the second controlling signal input ends of the switching circuit respectively receive a low level signal, the first input end electrically connects with the output end, thereby the resistors of the first external resistor string parallel connect to corresponding resistors of the internal resistor.

19. The gamma voltage output circuit as claimed in claim 18, further comprising a second external resistor string connecting between the power source and the ground, the first external resistor string comprising a plurality of resistors connecting in series and a plurality of nodes, wherein each switching circuit further comprises a second input end, the second input end of each switching circuit connected to each node of the second external resistor string, wherein when the enabling signal input end receives a high level signal, the first controlling signal input end receives a high level signal, and the second controlling signal input end receives a low level signal, the second input end electrically connects with the output end, thereby the resistors of the second external resistor string parallel connect to corresponding resistors of the internal resistor.

20. The gamma voltage output circuit as claimed in claim 18, further comprising a third external resistor string connecting between the power source and the ground, the third external resistor string comprising a plurality of resistors connecting in series and a plurality of nodes, wherein each switching circuit further comprises a third input end, the third input end of each switching circuit connected to each node of the third external resistor string, wherein when the enabling signal input end receives a high level signal, the first controlling signal input end receives a low level signal, and the second controlling signal input end receives a high level signal, the third input end electrically connects with the output end, thereby the resistors of the third external resistor string parallel connect to corresponding resistors of the internal resistor.

* * * * *